US005807468A

United States Patent [19]

Sakamoto et al.

[11] Patent Number: 5,807,468

[45] Date of Patent: Sep. 15, 1998

[54] ANODE ELECTROLYSIS ELECTRODE MATERIAL USING PRECIOUS METAL-BASED AMORPHOUS ALLOY SUITABLE FOR PLASTIC PROCESSING AND APPLICABLE TO A BULK MEMBER

[75] Inventors: Takumi Sakamoto; Takeshi Suto, both of Mito; Takahiro Aoki, Hitachinaka; Nobuyuki Nishiyama, Okaya; Akihisa Inoue, Sendai; Hisamichi Kimura, Miyagi; Yasusi Takahagi; Takeshi Kamoshida, both of Mito; Kazuya Saito, Shimodate, all of Japan

[73] Assignee: Japan Science and Technology Corporation, Saitama, Japan

[21] Appl. No.: 831,791

[22] Filed: Apr. 9, 1997

[30] Foreign Application Priority Data

Apr. 10, 1996 [JP] Japan ..... 8-088426

[51] Int. Cl.[6] ..... C25B 11/04

[52] U.S. Cl. ..... 204/293; 420/464; 420/468; 420/587

[58] Field of Search ..... 204/293; 420/464, 420/468, 587

[56] References Cited

U.S. PATENT DOCUMENTS

| | | | |
|---|---|---|---|
| 1,779,602 | 10/1930 | Kingsbury | 420/464 |
| 4,609,442 | 9/1986 | Tenhover et al. | 204/293 |
| 4,696,731 | 9/1987 | Tenhover | 204/293 |
| 4,781,803 | 11/1988 | Harris et al. | 204/293 |

FOREIGN PATENT DOCUMENTS

| | | |
|---|---|---|
| 0 163 410 | 12/1985 | European Pat. Off. . |
| 59-35417 | 8/1984 | Japan . |
| 62-96633 | 5/1987 | Japan . |
| 3-158446 | 7/1991 | Japan . |
| 4-68394 | 3/1992 | Japan . |
| 4-68394 | 11/1992 | Japan . |
| 5-65604 | 3/1993 | Japan . |

*Primary Examiner*—Bruce F. Bell
*Attorney, Agent, or Firm*—Evenson, McKeown, Edwards & Lenahan, P.L.L.C.

[57] ABSTRACT

An electrode having an excellent corrosion resistance and long service life even in a severe corrosive environment such as in NaCl solutions for anode electrolysis in which chlorine gas or the like is produced at a high potential from the alloy surface. The electrode of the invention is provided using a precious metal-based amorphous alloy which has a good plasticity processibility and is applicable to a large-sized component. The object is implemented by provision of an electrode material for anode electrolysis which utilizes a precious metal-based amorphous alloy which satisfies the general formula $NM_{100-a-b-c}Ni_aCu_bP_c$ wherein NM comprises one or two precious metal elements selected from Pd and Pt; a, b and c being atomic percent, satisfy that $30 \leqq a+b \leqq 45$, $3 \leqq b/a \leqq 7$, and $18 \leqq c \leqq 25$, respectively; Pt is contained from 10 to 30 atom percent (at. %); and wherein a temperature width $\Delta Tx$ in the supercooled liquid region ($\Delta Tx = Tx - Tg$) has a width of 70 K or more.

6 Claims, 10 Drawing Sheets

ANODE ELECTROLYSIS ELECTRODE MATERIAL USING PRECIOUS METAL-BASED AMORPHOUS ALLOY SUITABLE FOR PLASTIC PROCESSING AND APPLICABLE TO A BULK MEMBER

BACKGROUND OF THE INVENTION

1. Field of the Invention

The present invention relates to an electrode for anode electrolysis having a high corrosion resistance and a long service life suitable for use in various corrosive solutions such as a sodium chloride solution, and in particular it relates to manufacture and provision of such electrodes using a precious metal-based amorphous alloy which has a good plasticity processibility and is applicable to a large-sized component. Use of such electrodes enables its application in chemical and other industries. Further, due to its excellent corrosion resistance, this alloy can be used as an anti-corrosion material.

2. Description of the Prior Art

As a conventional electrode material for use in electrolysis of a solution such as sodium chloride or the like, a precious metal such as platinum (Pt) is generally used.

It is required for an electrode for use in electrolysis to have a high electrolysis efficiency to its target object, ensure a stable electrolysis efficiency for a long time, and exhibit a high corrosion resistance in a stringent oxidizing environment.

Conventional precious metal materials such as pure platinum and the like now in use are associated with the following problems. One such example will be described in reference to an anodic electrolysis in NaCl solution using pure Pt.

(1) The effective surface area effective for production of chlorine gas decreases with the progress of surface oxidization on the electrode due to a continuous and long duration of electrolysis in NaCl solution. As a result, an increasing overvoltage results from production of chlorine gas, thereby increasing the amount of oxygen gas to be produced, consequently lowering the chlorine production efficiency, and degrading reliability of the electrode in its long range service life, (2) In order to reactivate an electrode whose chlorine production efficiency has dropped, a surface reactivation treatment such as grinding or reverse electrolysis is required, thereby taking much time for such maintenance work, (3) When left in air after electrolysis, the chlorine production efficiency decreases, and (4) Provision of electrode materials using precious metals is costly.

As prior art precious metal-based amorphous alloys, JP-B Publication No. 59-35417 discloses a method of manufacturing amorphous alloy wires comprehensively including compositions of transition metal-semimetal amorphous alloys.

However, its diameter of alloy wires is less than 0.51 mm, and there are no specific descriptions as to whether or not the alloy wires have a good plasticity processibility and are applicable to a large-sized (bulk) component, and still further, no discussions are made regarding applicability to anodic electrolysis electrode materials.

Electrode materials using amorphous alloys are disclosed in JP-A No. 62-96633, JP-A No. 4-68394 and JP-A No. 5-65604. Although they have improved properties as anodic electrolysis materials, they inherently involve the following problems.

(1) The amorphous alloy disclosed in JP-A No. 5-65604 is made by a method which changes only the surface portion into an amorphous phase utilizing a high energy intensity beam. The disadvantage that the boundary region of the beam on the surface tends to crystallize, produce holes and defects, thereby restricting obtaining a homogeneous amorphous structure.

(2) The alloys disclosed in JP-A Nos. 62-96633 and 4-68394 have only a small temperature width ΔTx which ensures amorphous formation capability in a super cooled liquid region, thereby making it difficult to obtain a bulk amorphous structure. Therefore, available product sizes of amorphous alloys are limited to foil strips and lamina.

(3) The alloys disclosed in JP-A Nos. 62-96633 and 5-65604 need enrichment of precious metal elements which contribute to electrolysis by a surface activation process using hydrofluoric acid.

(4) The alloy disclosed in JP-A No. 4-68394 requires a surface activation processing to provide a porous surface layer by the steps of diffusion coating the surface with Zn to form a Zn containing alloy layer, then selectively dissolving Zn by alkali or acid solution processing.

SUMMARY OF THE INVENTION

As described above, there have been realized no alloy materials either crystalline or amorphous which satisfy at the same time excellent property as an anodic electrolysis electrode material, a good plasticity processibility, and its applicability to a large bulk component.

In the research level, however, precious metal-based amorphous alloys having an improved plasticity processibility and applicable to a bulk component has been discovered.

The present invention to provides an electrode material for use in electrolysis, which utilizes newly discovered amorphous alloys referred to above, has a high electrolysis efficiency and a long service life without need of activation processing, and is capable of being formed into various shapes.

"Corrosion resistance" referred to herein indicates a property to ensure that there occurs no corrosion in the surface of an alloy even in a stringent corrosive environment such as in gases of $C1_2$, $H_2S$, $SO_2$ or $NO_2$.

(1) An electrode material for use in anodic electrolysis made of an amorphous alloy according to the invention utilizes a precious metal-based amorphous alloy which is comprised of alloying compositions comprehensively expressed by the general formula of $NM_{100-a-b-c}Ni_aCu_bP_c$ (where NM is one or two precious metal elements selected from Pt and Pd; a, b, and c in the formula are atomic percent (at. %), and satisfy $30 \leqq a+b \leqq 45$, $3 \leqq b/a \leqq 7$, and $18 \leqq c \leqq 25$, respectively, and wherein Pt is contained from 10 to 30 in atomic percent), and wherein the precious metal-based amorphous alloy has a temperature width ΔTx broader than 70 K in a super cooled liquid region, ΔTx is defined by ΔTx=Tx−Tg, where Tx is the crystallization temperature and Tg is the glass transition temperature.

(2) The electrode material for anodic electrolysis made of the amorphous alloy according to the invention utilizes the precious metal-based amorphous alloy which has a cross-sectional area of 20 $mm^2$ or more, a length of 50 mm or more, and contains an amorphous phase of 90% or more in volume percent.

(3) The electrode material for anodic electrolysis made of the amorphous alloy according to the invention utilizes the precious metal-based amorphous alloy which is formed by plasticity processing by making use of its viscous fluidity in the supercooled liquid region.

(4) The electrode material for anodic electrolysis made of the amorphous alloy according to the invention utilizes the above-mentioned precious metal-based amorphous alloy, the alloy structure of which exhibits an amorphous monolayer structure before subjecting to heat treatment, and a heterogeneous structure having both amorphous and crystalline structures coexisting therein after the heat treatment.

The alloying compositions of the above-mentioned amorphous alloy according to the invention have such advantages over the prior art disclosed in JP-B Publication No. 59-35417 that (1) anodic electrolysis electrode materials of the invention can be formed into various shapes since they have an excellent plasticity processibility and are readily applicable to a large-sized component, that (2) they exhibit excellent properties required for the anodic electrolysis electrode materials of a high corrosion resistance and a long service life, and that both advantages of the above (1) and (2) are satisfied at the same time.

Means for providing such advantages described above will be set forth in the following.

The amorphous alloy inherently has a unique structural feature due to its amorphous atomic arrangement and a unique feature in compositions that allows a homogeneous distribution of various alloying elements, thereby exhibiting excellent functions such as high strength, corrosion resistance, soft magnetism and the like. This, eventually, allows various combinations of unique alloying compositions that cannot be obtained by crystalline metals, and also it is implied that there takes place a change in their electrochemical properties from observation of changes in electron distributions therein.

When an application to a large-sized component is contemplated, there will be, of course, required provision of a large-sized amorphous alloy. However, only a foil strip, lamina, powder or wire can be formed according to the conventional methods of manufacture of amorphous alloys. The inventors of the present invention have successfully developed a method to enable manufacture of a large-sized amorphous alloy by remarkably improving the amorphous formation capability of alloy itself using the precious metal-based amorphous alloy manufacturing methods discovered and proposed in the research level described above, which now will be described in the following.

The inventors focused on a novel concept that the atomic liquid structure, i.e., amorphous structure, can be stabilized when the melting point of its alloy is lowered thereby advantageously improving the amorphous formation capability thereof remarkably. Then, as a result of study, the inventors discovered a new fact that when proportions of Ni and Cu in the alloying compositions according to the invention satisfy a certain proportion, the melting point of the alloy drastically is caused to drop, thereby improving its amorphous formation capability substantially.

In addition, the present inventors discovered that at the certain proportion of Ni and Cu described above, resistance to crystallization is found to increase since a resulting precipitation phase increases its complexity at a time of crystallization. This implies that heat energy required for crystallization increases, thereby increasing the crystallization temperature. However, since the glass transition temperature does not change substantially, the temperature width $\Delta T$ in the supercooled liquid region expands remarkably. Therefore, the supercooled liquid state is more stabilized, thereby facilitating plasticity processing of the amorphous alloy after manufacture thereof.

Further, it is known as disclosed in JP-A Laid-Open No. 3-158446 and others that an amorphous alloy having a specific composition, when heated at a certain rate of temperature rising, undergoes transition to a supercooled liquid state in a temperature region below its crystallization temperature. In such supercooled liquid state, viscosity of the amorphous alloy decreases rapidly, thereby fabrication of the amorphous alloy into any arbitrary form becomes possible in this temperature region using appropriate processing methods such as enclosed forging or the like.

Now, a method of manufacture of amorphous alloys according to the invention will be described in the following with reference to the accompanying drawings. FIG. 3 depicts a schematic diagram of an apparatus for providing amorphous alloys according to the invention. One example of providing a bar-shaped sample using such apparatus will be described. In the production stage, a raw material 52 having a prescribed alloying composition is loaded in quartz tube 51 which has a predetermined diameter, then the inside of the quartz tube 51 is degassed through an open end thereof using a vacuum pump 53, then the open end thereof is sealed by a burner, thereby forming the quartz tube into a capsule. This capsule is heated in an oven 54 to a predetermined temperature such that the raw material of alloy 52 is completely melted therein. The melted raw material of alloy 52 is either cast in a die having a cavity having the shape of the product, or quenched in cooling medium 55 together with the quartz tube to be solidified by an appropriate cooling method. Since the amorphous formation capability according to the invention has been substantially improved over the conventional amorphous alloy production methods, a preferred amorphous phase can be formed effectively at a smaller cooling rate. In other word, a larger product of amorphous alloy can be obtained at the same cooling rate as a conventional process.

Further, these alloys of the invention can be obtained by a conventional vapor deposition method such as sputtering or by a solid method such as mechanical alloying or the like as well.

According to the concept of the invention and means for implementing the same described above, a unique precious metal-based amorphous alloy and amorphous alloy material which are applicable to a large-sized component and have an excellent plasticity processibility have been provided.

When an amorphous alloy of the invention is used as an electrode material for anode electrolysis, its alloying composition is required to be specified due to the following reasons.

Semimetal element P is a basic element which allows manufacture of the amorphous alloy of the invention. However, when its amount is less than 18 atomic percent (at. %) or over 25 at. %, an amorphous will not form.

The total amount of addition of Ni and Cu is controlled within a range from 30 to 45 at. % since outside the range, i.e., less than 30 at. % or more than 45 at. %, the amorphous formation capability is lowered.

Further, the proportion of Cu to Ni in the alloying compositions contributing to the main advantage of the invention will be described. When the proportion of Cu to Ni is less than 1, the melting point of the alloy does not decrease sufficiently so as to be able to improve its amorphous formation capability. Further, when the proportion thereof is between 1 and 3 or more than 7, a resultant crystalline phase structure becomes rather simple which is less resistive to or more prone to crystallization, thereby narrowing its supercooled liquid region. This, eventually, deteriorates plasticity processibility of the amorphous alloy after its manufacture.

As a result of consideration of the above, the proportion of Cu to Ni is defined to be within a range of 3 to 7.

Further, since Pt is an important element which influences the electrolysis efficiency and amorphous formation capability, and when the amount of its addition is less than 10 at. %, a resultant corrosion resistance and electrolysis efficiency become lowered, and when the amount of its addition exceeds 30 at. %,its resultant electrolysis efficiency and amorphous formation capability become lowered, therefore, the amount of its addition is determined to be within a range of 10 to 30 at. %.

This is why the proportion of compositions in the amorphous alloys of the invention is specifically defined, and why the anode electrolysis electrode materials made of amorphous alloys have such excellent properties.

Other modifications of the amorphous alloys and electrode materials of the invention which include small amounts, for example, approximately 2 at. %, of other elements such as Fe, Co, Si, Cr, Mn, Ti or the like should be construed within the scope of the invention.

BRIEF DESCRIPTION OF THE DRAWINGS

These and other objects of the invention will become more apparent in the detailed description and examples with reference to the accompanying drawings, in which.

PREFERRED EMBODIMENTS OF THE INVENTION

Preferred embodiments of the invention will be described in detail with reference to the accompanying drawings.

Figure 1:
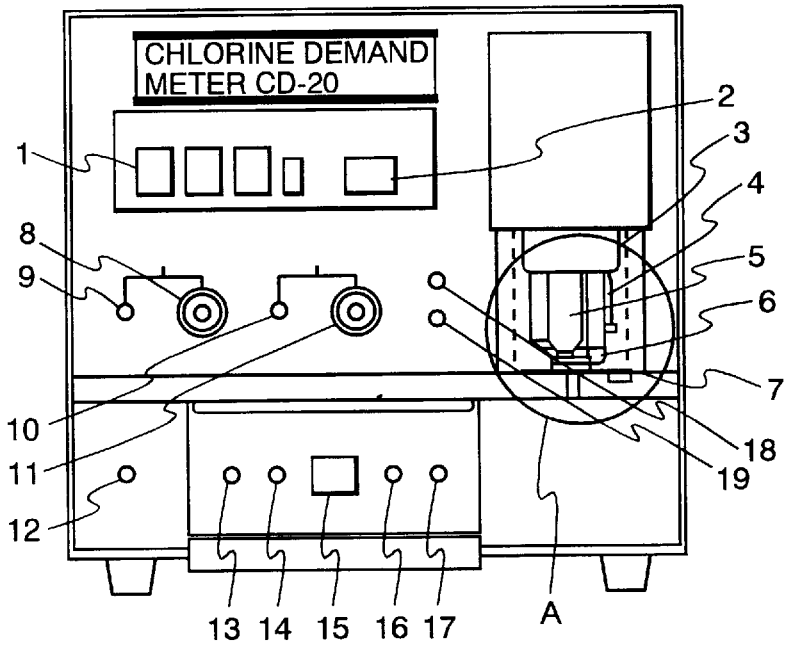
FIG. 1 is a schematic block diagram of an apparatus, chlorine demand meter CD-20, embodying the invention.
Figure 2:
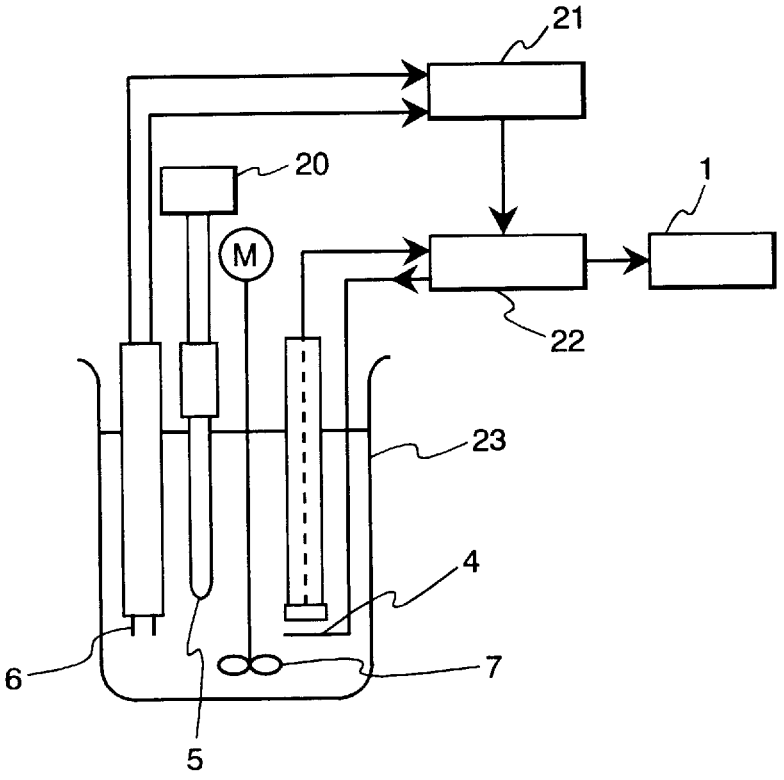
FIG. 2 is a schematic block diagram in part of FIG. 1, indicating more in detail its measurement mechanism of the invention.

FIG. 1 indicates a schematic block diagram of a chlorine demand meter CD-20 which utilizes an amorphous alloy of the invention. FIG. 2 indicates a measurement mechanism of part of FIG. 1 in detail.

Chlorine demand meter CD-20 is well known and available in the market. In the drawing of FIG. 1, numeral 1 depicts an indicator for indicating measured values, 2 depicts an indicator for indicating time, 3 depicts a measurement beaker (100 ml), 4 depicts an electrode for electrolysis, 5 depicts a ultraviolet lamp, 6 depicts sensing electrode, 7 depicts a stirrer, 8 depicts a blank setting dial, 9 depicts a blank setting switch, 10 depicts a span setting switch, 11 depicts a span setting dial, 12 depicts a power switch, 13 depicts a stirrer switch, 14 depicts a measurement stop switch, 15 depicts a measurement time set switch, 16 depicts a electrolysis electrode activation switch, 17 depicts a control system breaker switch, 18 depicts a measurement lamp, 19 depicts a measurement start switch, 20 depicts a measurement lamp power source, 21 depicts a controller, 22 depicts an electrolysis current, and 23 depicts a measurement beaker.

With reference to FIG. 2, details of the measurement mechanism using the electrode of the invention are illustrated.

As clearly indicated in FIG. 2, respective measurement portions are immersed in NaCl solution, and when current 22 is caused to flow through electrode 4 according to the invention with ultraviolet lamp 5 turned on and stirrer 7 operating, mainly a chlorine gas is produced at electrode 4. The chlorine gas produced at electrode 4 reacts with organic substances, ammonium and the like present in the solution. The rate of production of the chlorine gas is faster than the reaction speed of the chlorine gas with the organic substance and ammonium, thereby the chlorine gas becomes temporarily excessive and is liberated as the residual chlorine.

This liberated residual chlorine gas is sensed by sensing electrode 6. When this residual chlorine gas is sensed to have exceeded a predetermined level of amount, controller 21 is activated to interrupt electrolysis current 22. Since the liberated chlorine gas is caused gradually to react with the organic substances and ammonium present in the solution, the amount of the residual chlorine decreases accordingly. When the amount of the residual chlorine gas becomes less than 1 mg/l, the controller 21 restarts operation causing electrolysis current 22 to flow to the electrode 4, thereby repeating the above-mentioned reaction.

After completion of such reaction, the amount of chlorine expended in the measurement is read from indicator 1.

Figure 3:
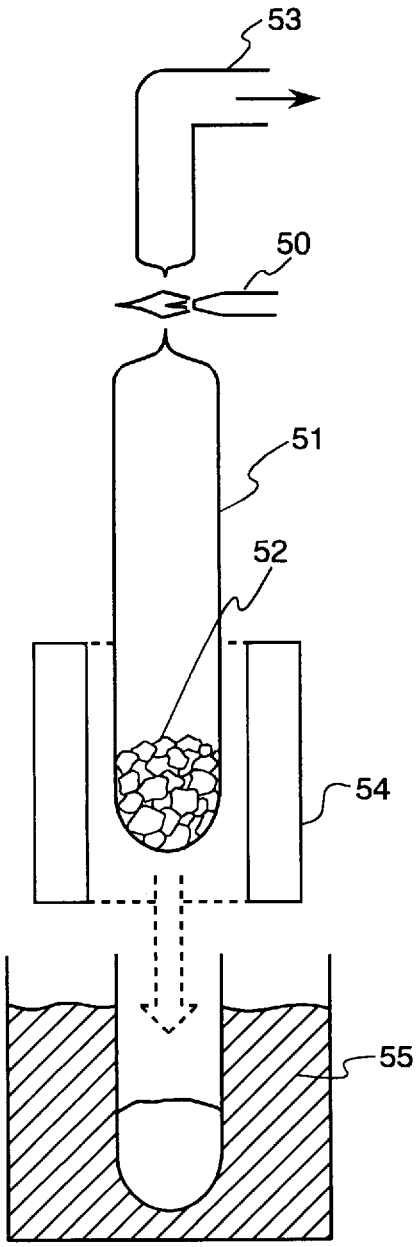
FIG. 3 is a cross-sectional, frontal view in part of an apparatus for manufacturing amorphous alloy samples formed into bar type specimens according to the invention.

1. EMBODIMENT 1:

Various sample materials having alloying compositions as shown in Table 1 including samples Nos. 1–7 embodying the invention and comparison examples Nos. 1–7 were prepared using the apparatus of FIG. 3. Each sample was fabricated into a bar type specimen with a cross-sectional area of 20 $mm^2$ and a length of 100 mm. Formation of an amorphous phase in each sample was examined using the X-ray diffraction method and an optical microscope. With reference to FIG. 3, alloying raw material 52 is loaded in quartz tube 52 which communicates via piping 53 with a vacuum pump (not shown), then the vacuum pump is operated to degas the inside of the quartz tube 51. Then, the connection between the quartz tube and the piping is cut and sealed by burner 50. In this state, alloying raw material 52 is heated to melt in oven 54. After being heated to a predetermined temperature, it is cooled in cooling medium 55.

Further, respective alloying samples embodying the invention and comparison samples were subjected to measurements using a differential scanning calorimeter (DSC)

which is normally used for thermal analysis of amorphous alloys at a rate of temperature rising of 20 K/min. thereby determining crystallization temperature Tx(K), glass transition temperature Tg(K) and temperature width ΔTx(K) (ΔTx=Tx−Tg) in the supercooled liquid region. Evaluation of plasticity processibilities of the sample alloys of the invention and the comparative samples was performed by applying a bending stress to the bar specimens of these alloys which were heated in oil bath to a super cooled liquid temperature region, so as to bend as much as 90 degrees, and their elasticity processibilities were determined according to a presence of a crack in a deformed portion. Results of the evaluations are shown in Table 2.

TABLE 1

| Sample Nos. | Alloy Compositions (in at. %) | Cu/Ni |
|---|---|---|
| Embodiment Sample 1 | $Pd_{30}Ni_{10}Cu_{30}P_{20}Pt_{10}$ | 3 |
| Embodiment Sample 2 | $Pd_{20}Ni_{10}Cu_{30}P_{20}Pt_{20}$ | 3 |
| Embodiment Sample 3 | $Pd_{10}Ni_{10}Cu_{30}P_{20}Pt_{30}$ | 3 |
| Embodiment Sample 4 | $Pd_{30}Ni_{8}Cu_{32}P_{20}Pt_{10}$ | 4 |
| Embodiment Sample 5 | $Pd_{22}Ni_{6}Cu_{30}P_{22}Pt_{20}$ | 5 |
| Embodiment Sample 6 | $Pd_{23}Ni_{6}Cu_{36}P_{20}Pt_{15}$ | 6 |
| Embodiment Sample 7 | $Pd_{20}Ni_{6}Cu_{35}P_{20}Pt_{10}$ | 7 |
| Comparison Sample 1 | $Pd_{77.5}Si_{16.5}Cu_{6}$ | ∞ |
| Comparison Sample 2 | $Pd_{79}Si_{21}$ | — |
| Comparison Sample 3 | $Pd_{60}P_{20}Pt_{20}$ | — |
| Comparison Sample 4 | $Pd_{41}P_{19}Ir_{40}$ | — |
| Comparison Sample 5 | $Nb_{58.5}Ni_{40}Pd_{1}Ir_{0.5}$ | 0 |
| Comparison Sample 6 | $Pd_{10}Ni_{20}Cu_{20}P_{20}Pt_{30}$ | 1 |
| Comparison Sample 7 | $Pd_{30}Ni_{5}Cu_{45}P_{20}Pt_{10}$ | 9 |

TABLE 2

| Sample Nos. | Produced Phase* | ΔTx (K)☆ | Bending Tests in Supercooled Liquid Region |
|---|---|---|---|
| Embodi. Sam. 1 | Amorphous | 90 | Good |
| Embodi. Sam. 2 | Amorphous | 79 | Good |
| Embodi. Sam. 3 | Amorphous | 73 | Good |
| Embodi. Sam. 4 | Amorphous | 78 | Good |
| Embodi. Sam. 5 | Amorphous | 75 | Good |
| Embodi. Sam. 6 | Amorphous | 82 | Good |
| Embodi. Sam. 7 | Amorphous | 80 | Good |
| Comp. Sample 1 | Amorphous | 42 | Crack exists |
| Comp. Sample 2 | Crystalline | — | Not deformable |
| Comp. Sample 3 | Crystalline | — | Not deformable |
| Comp. Sample 4 | Crystalline | — | Not deformable |
| Comp. Sample 5 | Crystalline | — | Not deformable |
| Comp. Sample 6 | Crystalline | — | Not deformable |
| Comp. Sample 7 | Crystalline | — | Not deformable |

(Note): In (*) marked column in Table 2, "Amorphous" indicates that there exists 90% or more amorphous portion in a produced phase, and "Crystalline" represents that there exists less than 90% amorphous portion therein.
(Note): In (☆) marked column in Table 2, each temperature width ΔTx in the supercooled liquid region was measured using DSC at a temperature rising rate of 20 K/min, and "—" symbol indicates that an accurate value could not have been determined due to a mixed coexistence of a crystalline structure, or that there exists no supercooled liquid region. It should be noted, however, that measured values are subject to a small variation.

As indicated in Table 2, all of the bar type specimens made of alloying compositions of embodiment samples Nos. 1–7 of the invention and of comparison sample No. 1 were found to contain an amorphous phase more than 90%, however, comparison samples Nos. 2–7 were found to have a smaller amorphous formation capability and a resultant structure which contains a crystalline phase more than 10%. Further, as a result of deformation tests in the supercooled liquid region, embodiment samples Nos. 1–7 of the invention were found to provide a good and sound deformation product without crack in the deformed portions thereof. Comparison samples Nos. 1–7, however, were found thermally unstable since their ΔTx is smaller than 70 K, thereby crystallization proceeded during temperature rising, and thus, did not provide a good and sound deformation product showing a crack propagation initiating from a crystalline phase in the deformed portion thereof.

Figure 4:
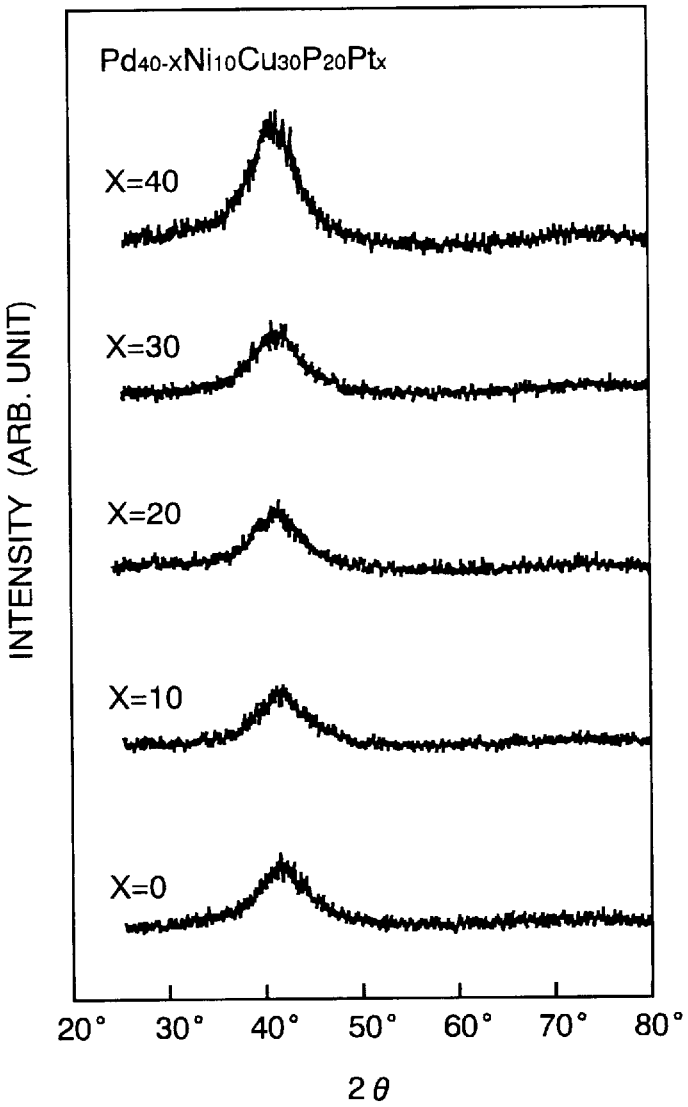
FIG. 4 is an X-ray diffraction pattern diagram of a sample alloy embodying the invention.
Figure 5:
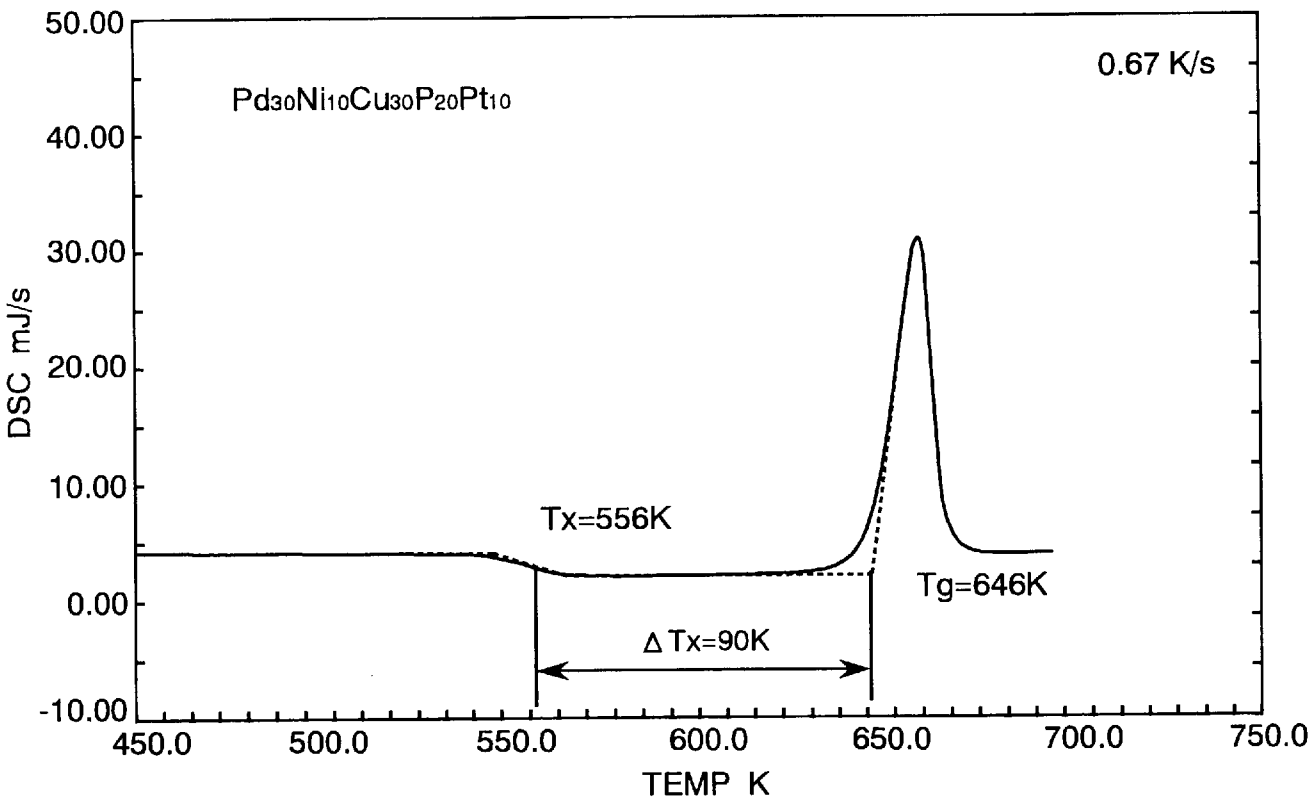
FIG. 5 is a diagram indicating a relation ($\Delta Tx=Tx-Tg$) between crystallization temperature Tx (K), glass transition temperature Tg (K) and temperature width $\Delta Tx$ (K) in supercooled liquid region.

An example of test results of X-ray diffraction tests on cross sections of a bar sample made of amorphous alloys according to the invention is shown in FIG. 4, and a DSC curve measured by the differential scanning calorimeter is shown in FIG. 5.

As shown in FIG. 4, only halo patterns are indicated in the diffraction diagrams, from which it is known that an amorphous monolayer was obtained.

As is obvious from the DSC curve in FIG. 5, the bar sample material made of amorphous alloy (embodiment sample No. 1)of the invention was found to have a crystallization temperature Tx at 556 K, glass-transition temperature Tg at 646 K, and temperature width ΔTx=90K in the supercooled liquid region.

2. EMBODIMENT 2:

Amorphous alloys were prepared by the above-mentioned method and their chlorine production efficiencies were measured and compared with each other between the above-mentioned alloys of embodiment samples, comparison alloys and pure Pt.

Measurements were performed in 2.5 M NaCl solutions with pH 5–6 at room temperatures, using these amorphous alloys as anode electrode for electrolysis. Examples of measurements are shown in Table 3.

TABLE 3

(electrode current densities less than 1 kA/m$^2$)

| Samples | Chlorine Production Efficiency (%) |
|---|---|
| Pure Pt | 90 |
| Embodi. Sam. No. 1 | 91 |
| Embodi. Sam. No. 2 | 90 |
| Embodi. Sam. No. 3 | 90 |
| Embodi. Sam. No. 5 | 91 |
| Comp. Sam. No. 1 | below 70 |
| Comp. Sam. No. 2 | below 70 |
| Comp. Sam. No. 5 | below 70, without activation |
| " | 70–80, with activation processing |

As is known from Table 3, all of the comparison alloys listed showed a low chlorine production efficiency below 80%.

Although comparison alloy No. 5 alone showed a chlorine production efficiency of 70–80% after surface activation processing, all of the amorphous alloys of the invention in the table showed a chlorine production efficiency of 90% or more without the activation processing.

Further, although pure Pt showed a chlorine production efficiency of approximately 90%, amorphous alloys of the invention which contained only 10–30 atomic percent of Pt, showed chlorine production efficiencies more than 90%.

Namely, the amorphous alloys manufactured according to the invention have been found to show a high chlorine production efficiency more than 90% comparable to pure platinum even though contained amount of Pt which contributes to the production of chlorine is very small.

3. EMBODIMENT 3:

For the above-mentioned amorphous alloys which exhibited chlorine production efficiencies more than 90%, a holding time for holding a 90% or more chlorine production efficiency was measured and compared with that of pure Pt.

Pure Pt was subjected to anode electrolysis in 2.5 M NaCl solution with pH 5–6 at room temperatures to measure its holding time, while the amorphous alloys of the invention were subjected to continuous anode electrolysis in 6.3 M NaCl solutions of pH 5–6 at room temperatures to measure their holding times.

Figure 6:
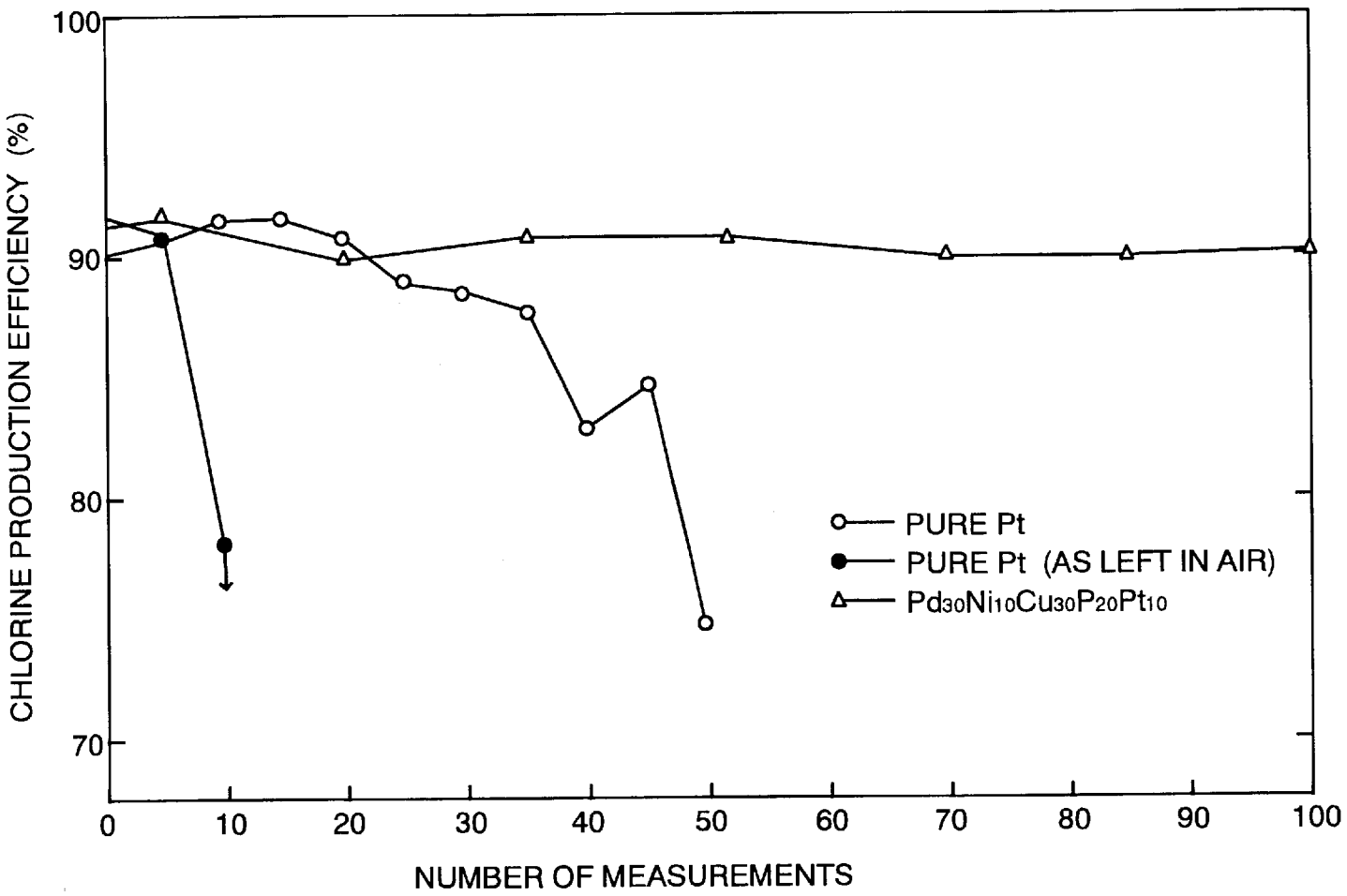
FIG. 6 is a diagram indicating stability of chlorine production efficiencies of the embodiment sample of the invention and pure platinum.

FIG. 6 shows a result of the measurements.

As indicated in FIG. 6, an amorphous alloying sample of the invention is confirmed to have an extended efficiency holding time longer than twice that of pure Pt.

The chlorine production efficiency of this amorphous alloy sample is very stable, and showed no decrease in its chlorine production efficiency even after being left in air after the anode electrolysis in the above-mentioned solutions, although such decrease was evidenced in pure platinum.

Namely, the amorphous alloy sample manufactured according to the invention ensures a more stable chlorine production efficiency to be obtained compared to pure Pt, and provide a material therefor at a reduced cost.

4. EMBODIMENT 4:

The amorphous alloy of embodiment sample No. 1 of the invention shown in FIG. 6 is confirmed to have a chlorine production efficiency over 90% and a stable holding time of its chlorine production efficiency twice or more of the holding time of pure Pt.

It is anticipated, however, that the above-mentioned characteristics of the amorphous alloy may change due to occurrence of a partial crystallization therein due to a problem attributable to a cooling rate or the like, which impairs manufacture of a bulk material using this amorphous alloy.

Thereby, alloy structures inclusive of both amorphous and crystalline structures are artificially fabricated by appropriate heat treatment, and experiments were conducted as to whether or not changes in the above-mentioned characteristics are observable.

Samples of experiments were prepared using embodiment sample No. 1 of the invention, and subjected to a heat treatment for three hours at a temperature 595 K which is lower by approximately 50 K than its crystallization temperature Tx.

Figure 7:
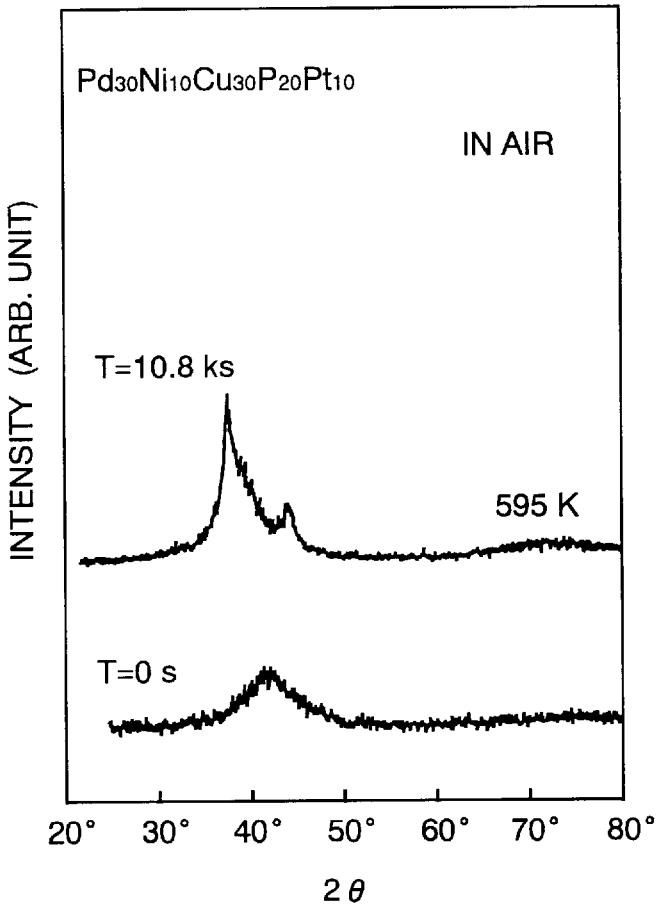
FIG. 7 is a diagram of X-ray diffraction patterns prior to and post heat treatment of the embodiment sample of the invention.

X-ray diffraction diagrams prior to and post the heat treatment are shown in FIG. 7.

As shown in FIG. 7, a result prior to heat treatment (bottom curve) indicates that an amorphous monolayer was obtained, while a result after the heat treatment (upper curve) indicates that a structure inclusive of both amorphous and crystalline phases was obtained.

Then, the alloys subjected to the heat treatment were examined of their chlorine production efficiencies and stabilities of the efficiencies, then compared with those prior to the heat treatment.

Figure 8:
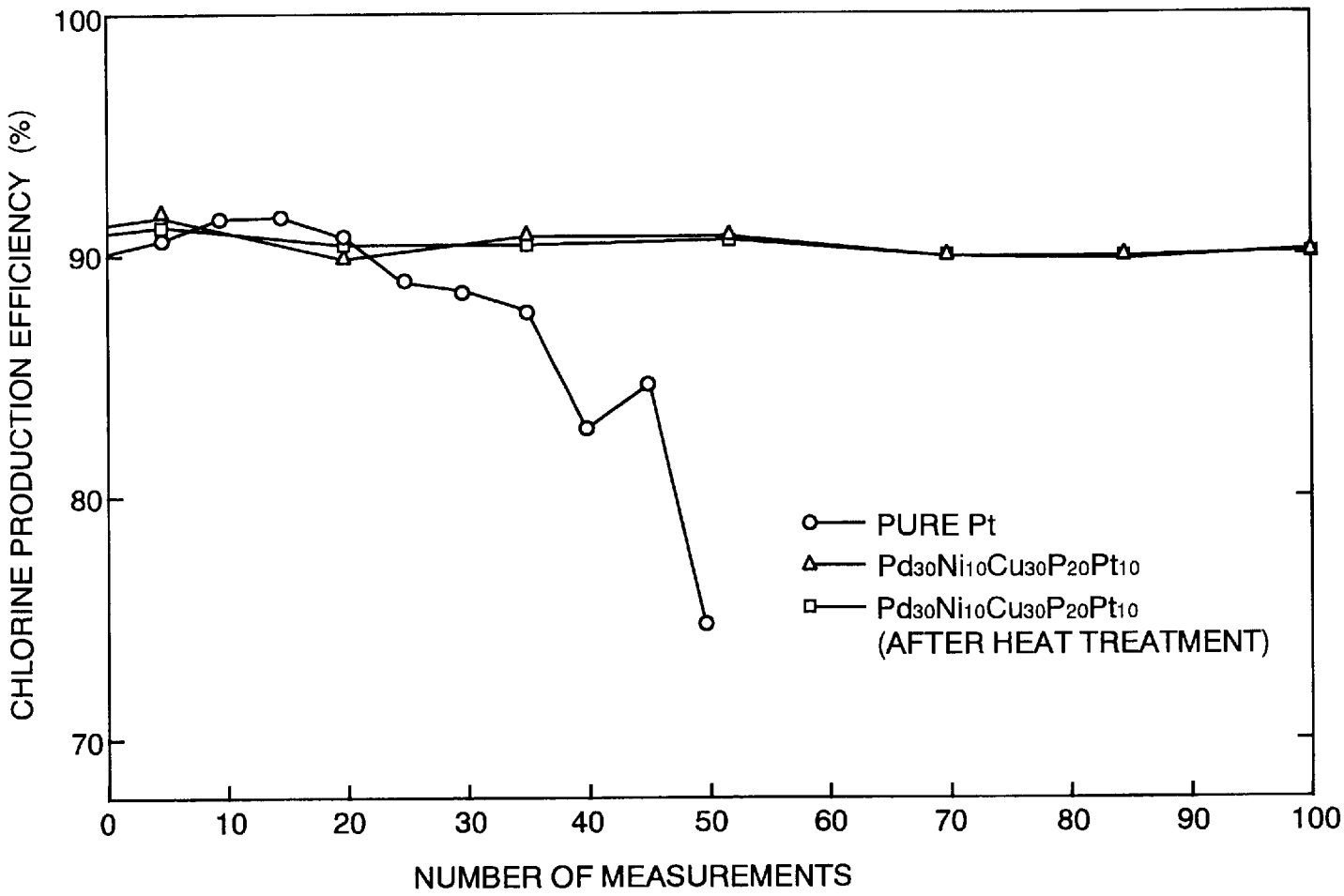
FIG. 8 is a diagram indicating stableness of chlorine production efficiencies prior to and post heat treatment of the embodiment sample of the invention.

A result of experiments and their comparisons are shown in FIG. 8.

Almost no substantial changes are observed in the efficiencies and stabilities between prior to and post the heat treatment as shown in FIG. 8.

That is, the amorphous alloy according to the invention inherently has a property that its characteristics of the high chlorine production efficiency and its stable holding time are retained even if the amorphous alloy does not have a completely amorphous structure.

5. EMBODIMENT 5:

Corrosion resistances of the alloys of the embodiment samples of the invention, comparative alloys and pure Pt were examined and compared by measuring their anode polarization characteristics and by chronopotentiometry measurements. Anode polarization measurements of these alloys were carried out by immersing these alloys in 2.5 M NaCl solutions of pH 5–6 at room temperatures, causing anode polarization to take place therein, and examining current behaviors by changing potentials from 0 to 1500 mV. The chronopotentiometry measurements were carried out by examining behaviors of potential in the same solutions as above with a constant current of 20 mA/cm$^2$.

Figure 9:
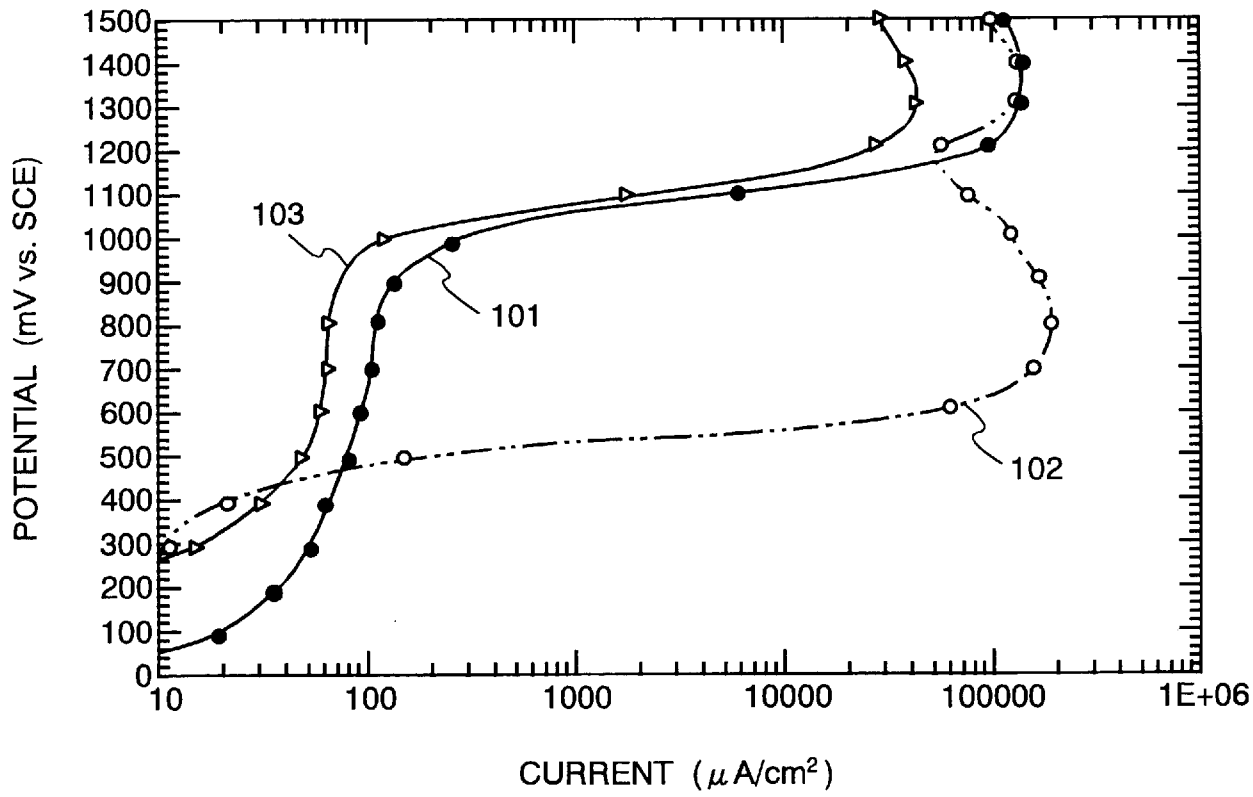
FIG. 9 is a comparison diagram comparing anode polarization curves of the embodiment sample of the invention, comparative sample alloy and pure platinum.

A result of the anode polarization measurements is shown in FIG. 9.

Chlorine gas production potentials are in a range of 1000 to 1300 mV.

As shown in FIG. 9, in the case of comparative alloy 102, even at potentials before approaching 1000 mV, a large increase in current is observed, and visually observable vigorous oxidization and dissolution, that is an evidence of corrosion occurrence is observed.

In the cases of sample alloy 101 embodying the invention and pure platinum 103 shown in FIG. 9, at potentials prior to approaching 1000 mV, the above-mentioned vigorous corrosion was not observed, and only a small current approximately of 100 $\mu$A/cm$^2$ was measured, then at the chlorine gas production potentials, an increase in currents associated with production of chlorine gas was confirmed, thereby verifying a high corrosion resistance thereof.

Figure 10:
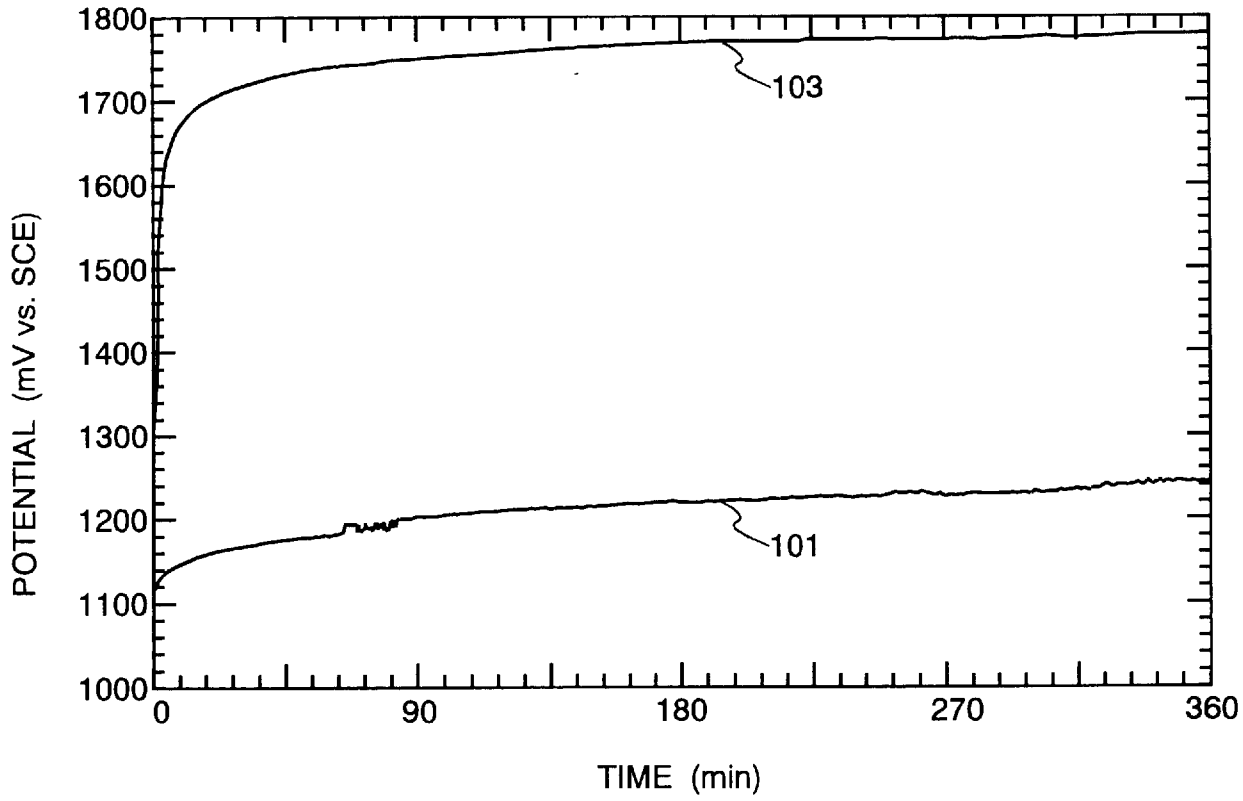
FIG. 10 is a comparison diagram comparing results of chronopotentiometry measurements of the embodiment sample of the invention and pure platinum.

Now, with reference to FIG. 10, a result of measurements by chronopotentiometry of the sample 101 embodying the invention and pure platinum 103 both of which exhibited high corrosion resistance in the anode polarization measurements is indicated. In the case of pure platinum, a rapid rise of potential from its initial potential at 1220 mV is already observed after elapse of time of 1–2 minutes as shown in FIG. 10, and its potential reaches 1700 mV or more after elapse of time of 60 minutes. This increase in potential is due to an increase in the surface resistance on the surface of Pt due to a progress of an oxidation film formation thereon.

In the case of the sample 101 embodying the invention shown in FIG. 10, an increase in potential is very small, namely, it increased from its initial potential at 1120 mM to a final potential at 1230 mV after elapse of time of 6 hours, thereby verifying that its oxidation film formation on the alloy surface is substantially retarded.

From these observations, it is verified that the amorphous alloys embodying the invention ensure the gas production potentials effective for production of a chlorine gas or the like to be maintained stably for a long duration of time.

By use of precious metal-based amorphous alloys of the invention which have a good plasticity processibility and are applicable to a large-sized component, it becomes possible to provide an excellent electrode material featuring an excellent corrosion resistance and long service life even in a sever oxidization environment where chlorine gas or the like is produced at high potential from the alloy surface in NaCl solutions or the like for anode electrolysis.

What is claimed is:

1. An electrode material for anode electrolysis utilizing a precious metal-based amorphous alloy comprising:

an alloying composition which satisfies the formula of $NM_{100-a-b-c}Ni_aCu_bP_c$, wherein:

NM is Pd or Pt or mixtures thereof;

a, b and c being atomic percent, satisfy that $30 \leqq a+b \leqq 45$, $3 \leqq b/a \leqq 7$, and $18 \leqq c \leqq 25$, respectively; When Pt is present it is present in an amount of from 10 to 30 in atomic percent; and wherein, the temperature width $\Delta Tx$ of said electrode material in a supercooled liquid region is 70 K or more, said $\Delta Tx$ being defined by $\Delta Tx = Tx - Tg$, where Tx is the crystallization temperature, and Tg is the glass-transition temperature.

2. An electrode material for anode electrolysis utilizing a precious metal-based amorphous alloy as claimed in claim 1, wherein said electrode has a cross-sectional area of 20 $mm^2$ or more and a length of 50 mm or more, and contains an amorphous phase 90% or more in volume percent.

3. An electrode material for anode electrolysis utilizing a precious metal-based alloy as claimed in claim 2, wherein said precious metal-based alloy has a structure which exhibits an amorphous monolayer prior to a heat treatment, and a mixed structure of amorphous and crystalline phases after the heat treatment.

4. An electrode material for anode electrolysis utilizing a precious metal-based amorphous alloy as claimed in claim 1, wherein said electrode material is subjected to deformation processing utilizing a viscous flow in a supercooled liquid region.

5. An electrode material for anode electrolysis utilizing a precious metal-based alloy as claimed in claim 4, wherein said precious metal-based alloy has a structure which exhibits an amorphous monolayer prior to a heat treatment, and a mixed structure of amorphous and crystalline phases after the heat treatment.

6. An electrode material for anode electrolysis utilizing a precious metal-based alloy as claimed in claim 1, wherein said precious metal-based alloy has a structure which exhibits an amorphous monolayer prior to a heat treatment, and a mixed structure of amorphous and crystalline phases after the heat treatment.

* * * * *